US005767626A

United States Patent [19]

Kamarehi et al.

[11] Patent Number: 5,767,626

[45] Date of Patent: Jun. 16, 1998

[54] ELECTRODELESS LAMP STARTING/ OPERATION WITH SOURCES AT DIFFERENT FREQUENCIES

[75] Inventors: Mohammad Kamarehi, Gaithersburg; Richard Pingree, Frederick, both of Md.; Jianou Shi, State College, Pa.

[73] Assignee: Fusion Systems Corporation, Rockville, Md.

[21] Appl. No.: 568,290

[22] Filed: Dec. 6, 1995

[51] Int. Cl.[6] ..... H01J 65/04

[52] U.S. Cl. ..... 315/39; 315/248

[58] Field of Search ..... 315/39, 248, 267, 315/344

[56] References Cited

U.S. PATENT DOCUMENTS

| | | | |
|---|---|---|---|
| 4,485,332 | 11/1984 | Ury et al. | 315/248 X |
| 4,633,140 | 12/1986 | Lynch et al. | 315/248 |
| 4,749,915 | 6/1988 | Lynch et al. | 315/248 |
| 4,894,592 | 1/1990 | Ervin et al. | 315/248 |
| 5,367,226 | 11/1994 | Ukegawa et al. | 315/248 |
| 5,448,135 | 9/1995 | Simpson | 315/248 X |
| 5,453,667 | 9/1995 | Matsuda et al. | 315/248 |
| 5,519,285 | 5/1996 | Ukegawa et al. | 315/248 X |

FOREIGN PATENT DOCUMENTS

| | | |
|---|---|---|
| 0 602 746 | 6/1994 | European Pat. Off. . |
| 39 20 649 | 1/1990 | Germany . |
| WO 94/08439 | 4/1994 | WIPO . |

*Primary Examiner*—Benny T. Lee

*Attorney, Agent, or Firm*—Pollock, Vande Sande & Priddy

[57] ABSTRACT

An electrodeless lamp is started by coupling microwave power of a first frequency to a lamp cavity, while the discharge is maintained by coupling microwave power of a second frequency, wherein the first frequency is lower than the second frequency. A cooling fluid is impinged on the lamp bulb immediately before the application of the microwave power of the first frequency.

17 Claims, 2 Drawing Sheets

ELECTRODELESS LAMP STARTING/ OPERATION WITH SOURCES AT DIFFERENT FREQUENCIES

BACKGROUND OF THE INVENTION

The present invention relates to a method and apparatus for starting electrodeless lamps, and particularly to such an apparatus for starting high pressure electrodeless lamps.

Electrodeless lamps are well known in the art, and generally comprise an electrodeless bulb to which microwave or r.f. power is coupled. The bulb contains a discharge forming fill, and when the power is coupled thereto, a discharge occurs.

For some applications, it is necessary or desirable to have a fill which is at a relatively high vapor pressure at room temperature. It is recognized that such high pressure fills are in general, difficult to start.

In the prior art, one approach to starting high pressure fills has been to use high frequency, high voltage, capacitively discharged electric fields such as provided by Tesla coils which generate a high electric field to cause initial ionization of a component of the gas fill. However, Tesla coils are more suited for laboratory experimentation than production discharge lamps.

Another approach of the prior art has been to apply a cooling fluid, such as liquid nitrogen to the bulb to cool it, typically by dipping the bulb into a container of liquid nitrogen. It is well known that cooling a gas will reduce its pressure or cause condensation, whereupon starting of the lamp will be easier.

BRIEF SUMMARY OF THE INVENTION

It is thus an object of the present invention to provide quick starting of an electrodeless lamp without using a Tesla coil.

In accordance with a first aspect of the invention, microwave power is coupled to the lamp cavity having a first frequency at which the cavity is resonant when the bulb is in the unexcited state to start the discharge, and after discharge is started, microwave power is coupled to the cavity at a second frequency which is higher than the first frequency to maintain the discharge. The lamp cavity is resonant at the second frequency with the bulb in the excited state.

In accordance with a second aspect of the invention, immediately prior to the above-mentioned application of microwave power at the first frequency, a cooling fluid is applied to the bulb to further facilitate starting. In accordance with a further aspect of the invention, a cooling fluid is applied to a bulb by being impinged on the bulb at a pressure greater than atmospheric pressure.

BRIEF DESCRIPTION OF THE DRAWING

The invention will be better understood by referring to the accompanying drawings, wherein.

DETAILED DESCRIPTION OF THE INVENTION

Figure 1:
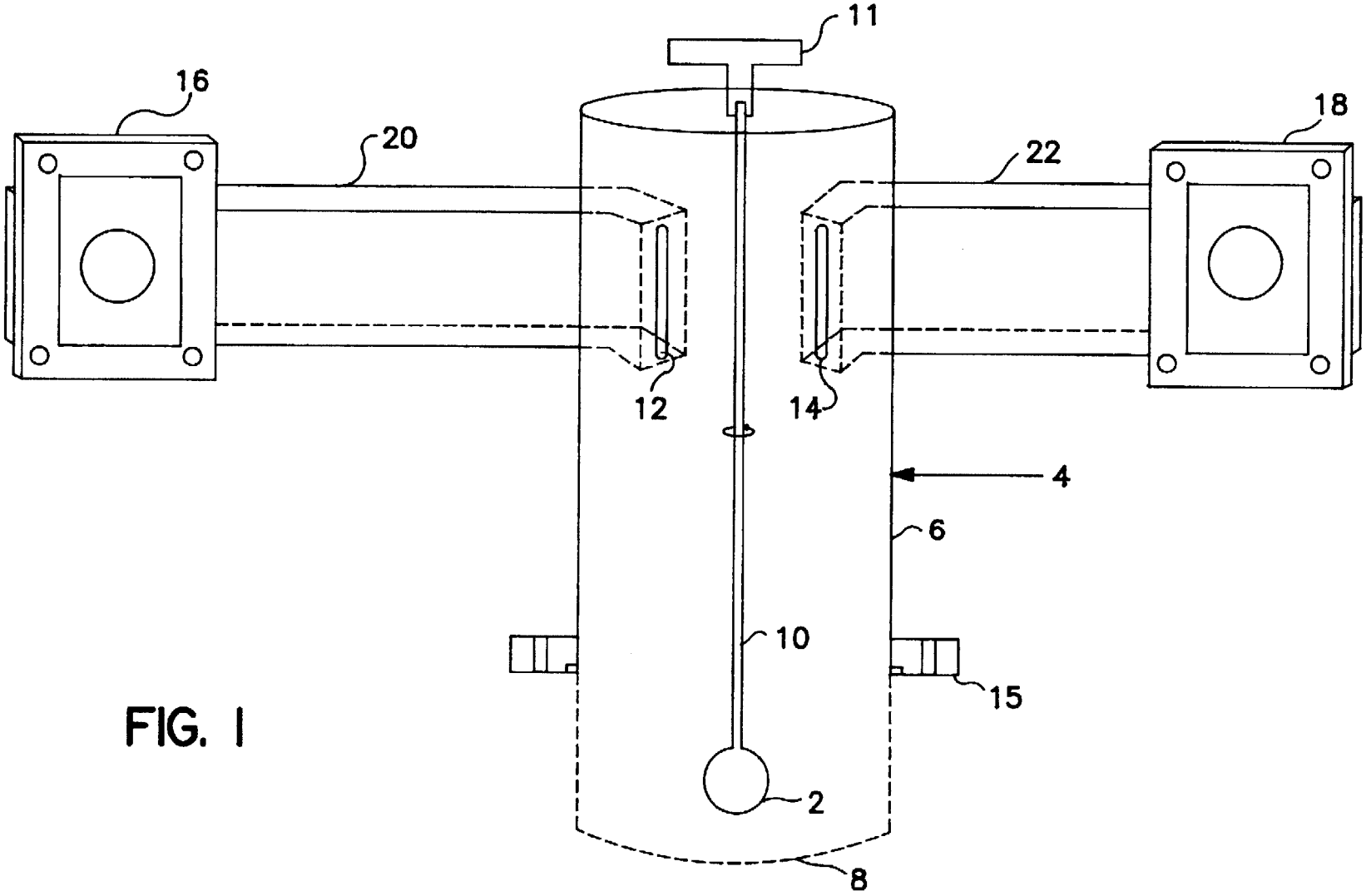
FIG. 1 depicts a first embodiment of the invention.

Referring to FIG. 1, bulb 2 is disposed in microwave cavity 4. Cavity 4 is cylindrical in shape (e.g. a cylindrical $TE_{111}$ cavity), and has a solid portion 6, and a mesh portion 8 which passes the radiation emitted by bulb 2, but substantially contains the microwave power. Bulb 2 is attached to stem 10 which is rotated by motor 11 during lamp operation, while cooling air from jets (not shown) is applied to the bulb wall to cool the bulb. Cavity 4 contains slots 12 and 14, which are for coupling microwave power to the cavity. Retaining collar 15 secures the mesh portion of the cavity 8 and the solid portion 6.

Bulb 2 is filled with a relatively high pressure fill, which is difficult to start. Examples of such fills include various rare gas/halogen combinations for providing excimer radiation and/or electronegative species. A particular fill which may be used is 600–1500 torr of XeCl. Another fill which may be used is argon.

Microwave generators 16 and 18 are provided, which may be magnetrons. The magnetrons generate microwave power which is fed through waveguides 20 and 22 respectively to coupling slots 12 and 14. As will be explained below the frequency of the microwave energy provided by magnetron 16 is lower than that which is provided by magnetron 18.

The length of cavity 4 adjusted so that the cavity is resonant at the frequency of magnetron 18 when the bulb is in the unexcited state. This is accomplished by a known method in the microwave art called "cold test analysis". Cavity 4 in the experimental stage may be provided with an adjustable end wall so as to determine the resonant length.

Since the cavity is resonant when the bulb is unexcited, maximum power transfer to the cavity will be achieved when the bulb is cold, thereby resulting in easier and faster lamp starting. After the lamp has ignited, magnetron 18 is turned on and magnetron 16 is turned off. This may be accomplished by a timing circuit or by a photocell sensing the output of bulb 2, which is connected to switching electronics, the design of which is well known in the art.

After bulb 2 is ignited, it becomes more conductive, thus effectively making the electrical dimensions of the cavity smaller. The frequency of magnetron 18 is selected to be higher than the frequency of magnetron 16 to compensate for the change in electrical dimensions after ignition, so that the cavity with the ignited bulb is resonant or near resonant at the frequency of the magnetron 18. In an actual embodiment which was built, the low frequency magnetron operated at 2440 Mhz , while the high frequency magnetron operated at 2470 Mhz .

Additionally, in one embodiment of the invention, magnetron 16 provides a pulsed rather than continuous output, which may provide even more effective starting. The pulses would be of relatively high peak power and short duration.

Figure 2:
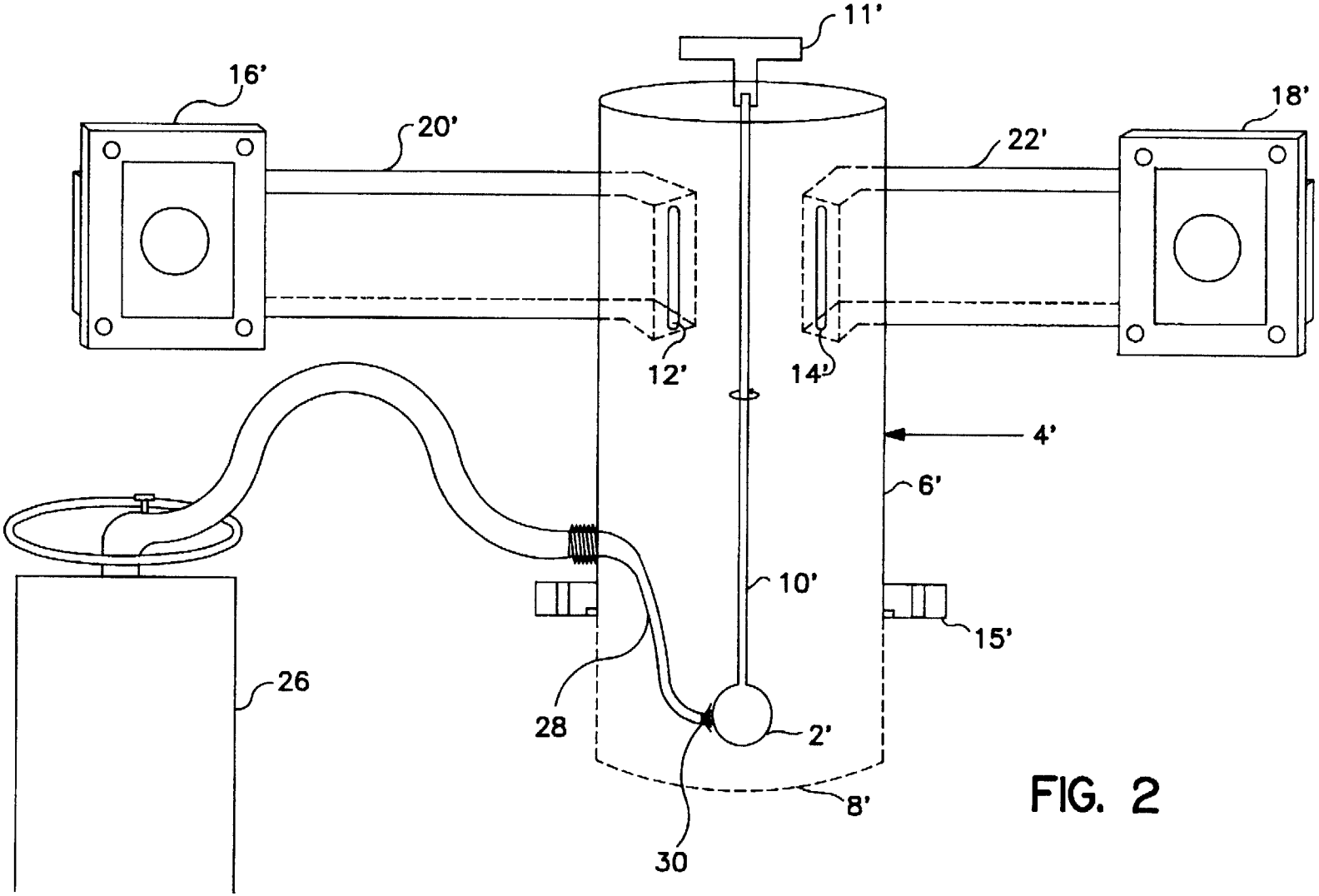
FIG. 2 depicts a second embodiment of the invention.

A second embodiment of the invention is depicted in FIG. 2. In this Figure, those parts which are also present in FIG. 1 are identified with the same reference numerals but with the addition of the prime (') designation, and which are not described in detail herein.

In the embodiment of FIG. 2, in addition to the use of the sequential magnetron excitation scheme of FIG. 1, a cooling fluid is applied to the bulb immediately prior to turning on of the magnetron 16. This reduces the pressure of the components in bulb 2' and further facilitates the starting of the lamp. The cooling fluid is impinged onto the bulb under pressure, for example, by being sprayed. Timing circuitry, well known to those skilled in the art, may be employed to make the spraying and magnetron turn-on operations automatic.

Referring to FIG. 2, liquid nitrogen storage tank 26 is shown. Cooling fluid under pressure is transported through line 28 to spray nozzle 30, where it is ejected in a spray onto bulb 2'. Alternatively, a non-spray nozzle could be used, in which case, the fluid would be squirted onto the bulb.

A particular application for the embodiment of FIG. 2 is in the starting of lamps having excimer forming fills for providing excimer radiation. In such lamps, a variety of halogen only or halogen/rare gas combinations may be used.

While the invention has been described in connection with illustrative and preferred embodiment, variations will occur to those skilled in the art, and it is therefore understood that the invention herein is defined in the claims which are appended hereto.

We claim:

1. A method of operating a difficult to start electrodeless lamp which includes a bulb enclosing a discharge forming fill which is disposed in a cavity, comprising the steps of, coupling microwave power to said cavity having a first frequency which corresponds to a resonant frequency of the cavity when the discharge forming fill in the bulb is in an unexcited states, to start a discharge in the bulb, and after the discharge is started, removing said microwave power having a first frequency and coupling microwave power to said cavity having a frequency which is higher than said first frequency to maintain said discharge in the bulb.

2. The method of claim 1 further including the step of, applying a cooling fluid to said bulb prior to when said microwave power having said first frequency is coupled to said cavity.

3. The method of claim 2 wherein said step of applying a cooling fluid comprises impinging said cooling fluid onto said bulb under pressure greater than atmospheric pressure.

4. The method of claim 3 wherein said step of impinging said cooling fluid onto said bulb comprises spraying said cooling fluid onto said bulb.

5. The method of claim 3 wherein said step of applying a cooling fluid comprises impinging liquid nitrogen onto said bulb.

6. An electrodeless lamp comprising, a cavity in which a bulb which encloses a discharge forming fill is located, first means for providing microwave power of a first frequency which corresponds to resonant frequency of the cavity when the discharge forming fill in the bulb is in an unexcited state, means for coupling said power of a first frequency to said cavity to start a discharge in the bulb, second means for providing microwave power of a second frequency which is higher than said first frequency, and means for coupling said power of a second frequency to said cavity to maintain said discharge in the bulb.

7. The lamp of claim 6 further including means for stopping said first means for providing microwave power from providing said power after said discharge in the bulb is started.

8. The lamp of claim 6 wherein said first means for providing microwave power is a means for providing pulsed microwave power.

9. The lamp of claim 8 further including means for applying a cooling fluid to said bulb to help the starting of said discharge in the bulb.

10. The lamp of claim 9 wherein said means for applying a cooling fluid comprises means for spraying said cooling fluid onto said bulb.

11. The lamp of claim 6 further including means for applying a cooling fluid to said bulb to help the starting of said discharge in the bulb.

12. The lamp of claim 11 wherein said means for applying a cooling fluid comprises means for spraying said cooling fluid onto said bulb.

13. The lamp of claim 11 wherein said cavity is a cylindrical $TE_{111}$ cavity and wherein both said means for coupling microwave power at said first and second frequencies include respective coupling slots communicating with the cavity.

14. An electrodeless lamp comprising, a cavity in which a bulb which encloses a discharge forming fill is located, means for squirting a cooling fluidunder pressure greater than atmospheric onto said bulb prior to when excitation power is coupled to said bulb, and means for coupling excitation power to said bulb.

15. An electrodeless lamp comprising, a cavity in which a bulb which encloses a discharge forming fill is located, means for spraying a cooling fluid under pressure greater than atmospheric onto said bulb prior to when excitation power is coupled to said bulb, and means for coupling excitation power to said bulb.

16. A method of starting a difficult to start electrodeless lamp bulb comprising the steps of, spraying a cooling liquid on said bulb at a pressure above atmospheric pressure prior to when excitation power is coupled to the bulb, and coupling excitation power to the already cooled bulb.

17. A method of starting a difficult to start electrodeless lamp bulb comprising the steps of, squirting a cooling liquid on said bulb at a pressure above atmospheric pressure prior to when excitation power is coupled to the bulb, and coupling excitation power to the already cooled bulb.

* * * * *